US008182274B1

(12) United States Patent
Cheng et al.

(10) Patent No.: US 8,182,274 B1
(45) Date of Patent: May 22, 2012

(54) POWER CONVERTER HAVING A PIVOTABLE AND RECEIVABLE PLUG

(75) Inventors: Hsiung-Kuei Cheng, Taipei (TW); Chung-Chien Tseng, Taipei (TW); Ming-Tsai Kao, Taipei (TW)

(73) Assignee: Cyber Power Systems Inc., Taipei (TW)

( * ) Notice: Subject to any disclaimer, the term of this patent is extended or adjusted under 35 U.S.C. 154(b) by 0 days.

(21) Appl. No.: 13/099,533

(22) Filed: May 3, 2011

(51) Int. Cl.
*H01R 13/44* (2006.01)

(52) U.S. Cl. ..... 439/131

(58) Field of Classification Search ..... 439/131, 439/171–175
See application file for complete search history.

(56) References Cited

U.S. PATENT DOCUMENTS

| | | | | |
|---|---|---|---|---|
| 5,967,807 | A * | 10/1999 | Wu | 439/131 |
| 6,126,460 | A * | 10/2000 | Wu | 439/131 |
| 6,222,717 | B1 * | 4/2001 | Waas et al. | 361/119 |
| 6,270,364 | B1 * | 8/2001 | Wang | 439/131 |
| 6,722,900 | B2 * | 4/2004 | Segawa et al. | 439/131 |
| 6,780,033 | B2 * | 8/2004 | Liu | 439/172 |
| 6,790,062 | B1 * | 9/2004 | Liao | 439/171 |
| 6,875,040 | B1 * | 4/2005 | O'Keefe et al. | 439/346 |
| 7,052,298 | B1 * | 5/2006 | Cheng | 439/171 |
| 7,193,873 | B2 * | 3/2007 | Lanni | 363/146 |
| 7,354,286 | B1 * | 4/2008 | Lee | 439/172 |
| 7,445,513 | B1 * | 11/2008 | Lee | 439/652 |
| 7,604,492 | B1 * | 10/2009 | Wang | 439/131 |
| 7,798,825 | B1 * | 9/2010 | Pai | 439/131 |
| 7,857,639 | B1 * | 12/2010 | Chang | 439/131 |
| 8,043,100 | B2 * | 10/2011 | Liao | 439/131 |
| 2003/0181082 | A1 * | 9/2003 | Wu | 439/131 |
| 2004/0038572 | A1 * | 2/2004 | Liu | 439/172 |
| 2004/0097114 | A1 * | 5/2004 | Shiroshita et al. | 439/174 |
| 2006/0110948 | A1 * | 5/2006 | Gerard | 439/21 |
| 2006/0110963 | A1 * | 5/2006 | Cheng | 439/171 |
| 2009/0291570 | A1 * | 11/2009 | Wadsworth | 439/13 |
| 2009/0311892 | A1 * | 12/2009 | Weeks | 439/137 |
| 2010/0248509 | A1 * | 9/2010 | Pai | 439/131 |
| 2011/0065327 | A1 * | 3/2011 | Chen | 439/660 |
| 2011/0097911 | A1 * | 4/2011 | Lee et al. | 439/108 |

* cited by examiner

*Primary Examiner* — Tulsidas C Patel
*Assistant Examiner* — Vladimir Imas
(74) *Attorney, Agent, or Firm* — C. G. Mersereau; Nikolai & Mersereau, P.A.

(57) ABSTRACT

A power converter having a pivotable and receivable power plug has a housing, an adapter board, a power output unit and a plug. The adapter board and the power output unit are mounted inside the housing. The adapter board has two conducting strips and a grounding strip. Each conducting strip has a shaft holder formed by bending a free end of the conducting strip, and two metal pivot shafts formed on two opposite sides of the plug are pivotally and respectively mounted in the shaft holders. The plug has a ground plate having a first engagement portion formed thereon. The grounding strip has a second engagement portion formed therein in a pivoting path of the plug to engage the first engagement portion and position the plug when the plug is pivoted and protrudes beyond the housing. Accordingly, the power converter can have a pivotable and receivable plug with minimum parts.

24 Claims, 12 Drawing Sheets

POWER CONVERTER HAVING A PIVOTABLE AND RECEIVABLE PLUG

BACKGROUND OF THE INVENTION

1. Field of the Invention

The present invention relates to a power plug, and more particularly to a pivotable and receivable power plug implemented with a simplified structure and minimum parts.

2. Description of the Related Art

An industrial society heavily and increasingly relies on the use of electric appliances. For the sake of diversified electric appliances in the market and power conversion devices specifically equipped for the electric appliances, a wide range of power conversion devices, such as power extension cords, transformers and rectifiers, are brought into play in that regard. As the power conversion devices must be connected with power sockets of power sources, each power conversion device needs to have a power plug to plug in a corresponding power socket. Usually, the power plugs of the power conversion devices are stationary and are uneasy to be receivable for being bulky.

With reference to FIG. 12, a conventional power converter having a pivotable and receivable power plug that is presented to solve the above issue has a housing 50, a plug 60, a turning piece 53, a positioning piece 54 and a circuit board 70.

The housing 50 has an upper case 51 and a lower case 52 mounted together. The upper case 51 has an elongated opening 511 formed through the upper case 51. The lower case 52 has a first slot 521, a second slot 522 and a third slot 523 to correspond to the elongated opening 511.

The plug 60 is mounted in the first slot of the lower case 52, and has a body 61, two parallel prongs 62, a first pivot shaft 63 and a second pivot shaft 64. The two prongs 62 are formed on a front portion of the body 61. The first pivot shaft 63 and the second pivot shaft 64 are respectively formed on and protrude from two opposite sides of a rear portion of the body 61. The first pivot shaft 63 has an engagement rib 631 formed on and protruding from a cylindrical periphery of the first pivot shaft 63. The second pivot shaft 64 has an angular stop 641 and two parallel conducting elements 621. The angular stop 641 is formed on and protrudes outwardly from a free end of the second pivot shaft 64. The two conducting elements 621 are mounted in one side of the second pivot shaft 64 and are respectively connected to the prongs 62.

The turning piece 53 is mounted in the second slot 522 of the lower case 52, protrudes beyond the elongated opening 511 of the upper case 51, is semicircular and has a semicircular hole 531, an engagement slot 532 and multiple teeth 533. The semicircular hole 531 is centrally formed through the turning piece 53 and mounted around the first pivot shaft 63. The engagement slot 532 is formed in and recessed from an inner wall of the semicircular hole 531 to communicate with the semicircular hole 531 and engage the engagement rib 631. The teeth 533 are formed on and protrude from a semicircumference of the turning piece 63.

The positioning piece 54 is mounted in the third slot 523 of the lower case 52, and has a pivot hole 541 formed through the positioning piece 54 for the angular stop 641 of the second pivot shaft 64 to be mounted in.

The circuit board 70 is mounted between the upper case 51 and the lower case 52, and has two conducting strips 71 mounted under the circuit board 70 and respectively located at two pivoting paths of the two conducting elements 621.

When the power conversion device is operated, the teeth 533 on the turning piece 53 in the elongated opening 511 of the upper case 51 are turned so that the prongs 62 on the front portion of the body 61 of the plug 60 are pivoted toward the elongated opening 511 and are exposed through the elongated opening 511. When the parallel conducting elements 621 are turned to a specific angle, the angular stop 641 on the second pivot shaft 64 is held by the positioning piece 54 so that the plug 60 is fixed and unrotatable. Meanwhile, the conducting elements 621 on the rear portion of the plug 60 respectively contact the conducting strips 71 and are electrically and respectively connected with the prongs 62 through the conducting strips 71. When the plug 60 is received, the turning piece 53 is turned reversely so that the prongs 62 are pivoted to return to the first slot 521 for storage.

Although the plug 60 of the power conversion device is pivotable and receivable, the conducting elements 621, the first pivot shaft 63 and the second pivot shaft 64 need to be formed on the plug 60 together with the conducting strips 71 and the positioning pieces 54 to ensure that the prongs 62 can be electrically connected with the conducting elements 621 when pivoted. Such structure requiring the use of many parts is not only complicated in manufacture but also expensive in cost.

SUMMARY OF THE INVENTION

An objective of the present invention is to provide a pivotable and receivable power plug implemented with a simplified structure and minimum parts.

To achieve the foregoing objective, the power converter has a housing, an adapter board, a power output unit and a plug.

The housing has a rectangular opening formed through one side thereof.

The adapter board is mounted inside the housing and has two conducting strips and a grounding strip. Each conducting strip is resilient and has a shaft holder formed by bending a free end of the conducting strip. The grounding strip has a first engagement portion formed thereon.

The power output unit is mounted inside the housing and electrically connected to the adapter board.

The plug is mounted inside the housing to align with the rectangular opening of the housing, and has a plug body, two prongs, a ground pin, a ground plate and two metal pivot shafts. The prongs and the ground pin are parallelly mounted in a front of the plug body. The ground plate is mounted in a rear of the plug body and electrically connected with the ground pin and has a second engagement portion formed thereon to correspond to the first engagement portion of the grounding strip. The metal pivot shafts are respectively mounted in a left side and a right side of the plug body, are electrically and respectively connected with the prongs, and are pivotally and respectively mounted in the shaft holders.

Alternatively, the power converter has a housing, a power output unit and a plug.

The housing has a rectangular opening, a cable hole, two conducting strips and a grounding strip. The rectangular opening is formed through a bottom thereof. The cable hole is formed through a rear thereof. Each conducting strip is resilient, and has a shaft holder formed by bending a free end of the conducting strip and securely mounted in the housing. The grounding strip is resilient and has a first engagement portion formed thereon.

The power output unit has multiple power wires passing through the cable hole and electrically and respectively connected with the conducting strips and the grounding strip.

The plug is mounted inside the housing to align with the rectangular opening of the housing, and has a plug body, two prongs, a ground pin, a ground plate and two metal pivot shafts. The prongs and the ground pin are parallelly mounted in a front of the plug body. The ground plate is mounted in a rear of the plug body and electrically connected with the ground pin and has a second engagement portion formed thereon to correspond to the first engagement portion of the grounding strip. The metal pivot shafts are respectively mounted in a left side and a right side of the plug body, are electrically and respectively connected with the prongs, and are pivotally and respectively mounted in the shaft holders.

When the plug is pivoted and the prongs and the ground pin protrude beyond the rectangular opening of the housing, the second engagement portion of the ground plate engages the first engagement portion of the grounding strip to position the plug. The prongs and the ground pin are further plugged into a power socket, and power can be transmitted to the power output unit through the prongs, the metal pivot shafts, the shaft holders and the adapter board. When the plug is received, the first engagement portion can disengage from the second engagement portion by gently applying a force on the plug, and the plug can be pivoted to return to the housing, and the prongs and the ground pin of the plug are hidden inside the housing. Thus, a power conversion device having a pivotable and receivable plug can be achieved with a simple structure and minimum parts.

Other objectives, advantages and novel features of the invention will become more apparent from the following detailed description when taken in conjunction with the accompanying drawings.

DETAILED DESCRIPTION OF THE INVENTION

Figure 1:
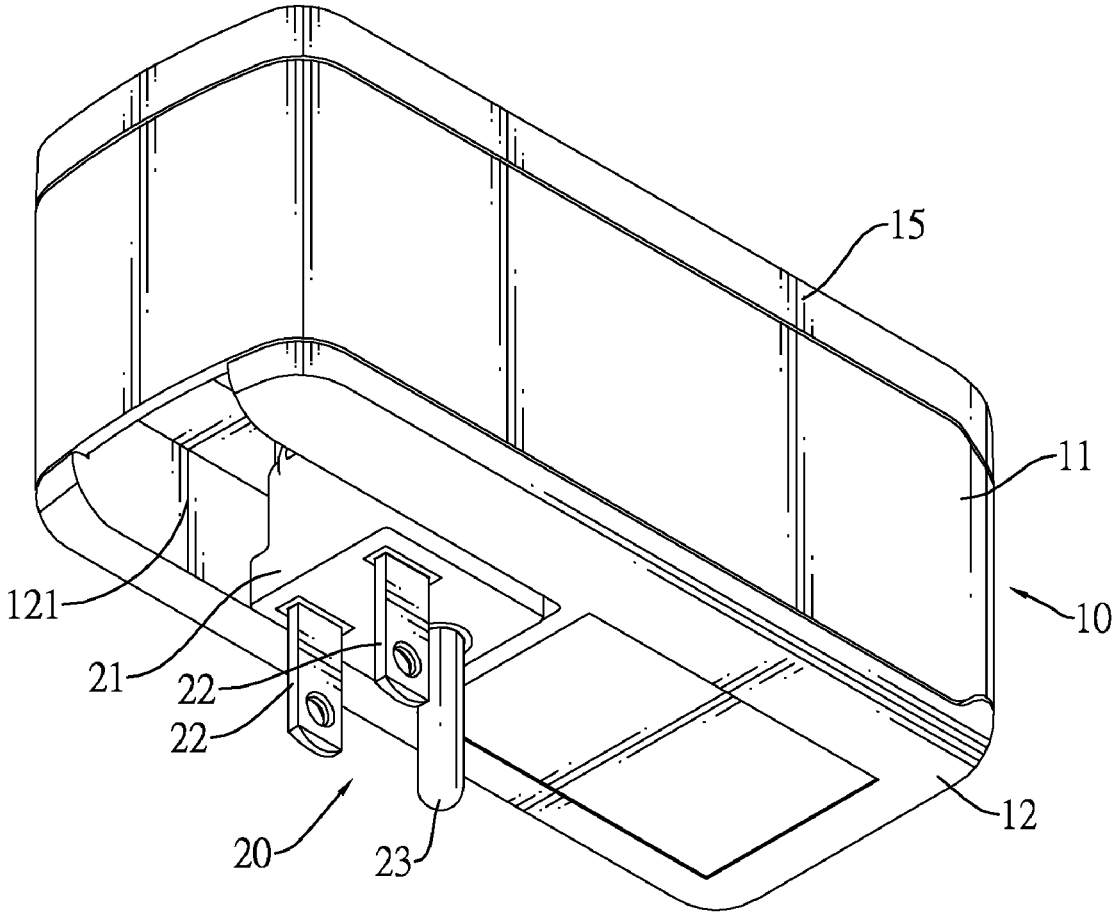
FIG. 1 is a first embodiment of a first perspective view of a power converter having a pivotable and receivable power plug in accordance with the present invention.

With reference to FIGS. 1 to 6, a power converter having a pivotable and receivable power plug in accordance with the present invention has a housing 10, an adapter board 30, a power output unit 40 and a plug 20.

The housing 10 has a body 11, a top cover 15 and a bottom cover 12. The body 11 has a chamber 13, two open sides and two pivot shaft slots 14. The chamber 13 is defined in the body 11. The open sides are respectively formed through a top and a bottom of the body 11. The pivot shaft slots 14 are respectively formed on two opposite inner sides of the body 11. The bottom cover 12 covers the open side on the bottom of the body 11 and has a rectangular opening 121 formed through the bottom cover 12. The top cover 15 covers the open side on the top of the body 10 and has multiple sockets 151 formed thereon.

The adapter board 30 is mounted in the chamber 13 of the housing 10 and has two conducting strips 32 and a grounding strip 33. Each conducting strip 32 is resilient and has a shaft holder 321 formed by bending a free end of the conducting strip 32, being U-shaped, and securely mounted in one of the pivot shaft slots 14 by abutting against two inner walls of the pivot shaft slot 14. The grounding strip 33 is resilient and has a first engagement portion 331 formed thereon.

The power output unit 40 is mounted in the housing 10 and electrically connected to the adapter board 30. In the present embodiment, the power output unit 40 is a multiple-socket receptacle strip mounted in the housing 10 and corresponding to the sockets 151 of the top cover 15 so that an external power plug can be electrically connected to the power output unit 40 through a corresponding socket 151. The power output unit 40 may be a power output port of a rectifier or a power output port of a transformer.

The plug 20 is mounted in the housing 10 to align with the rectangular opening 121 of the bottom cover 12, and has a plug body 21, two prongs 22, a ground pin 23, a ground plate 24 and two metal pivot shafts 25. The prongs 22 and the ground pin 23 are parallelly mounted in a front of the plug body 21. The ground plate 24 is mounted in a rear of the plug body 21 and is electrically connected with the ground pin 23. The ground plate 24 has a second engagement portion 241 formed thereon to correspond to the first engagement portion 331 of the grounding strip 33. The metal pivot shafts 25 are respectively mounted in a left side and a right side of the plug body 21, are electrically and respectively connected with the prongs 22, and are pivotally and respectively mounted in the shaft holders 321. The first engagement portion 331 may be a recess, and the second engagement portion 241 is a bump, or vice versa, to engage the first engagement portion 331.

Figure 7:
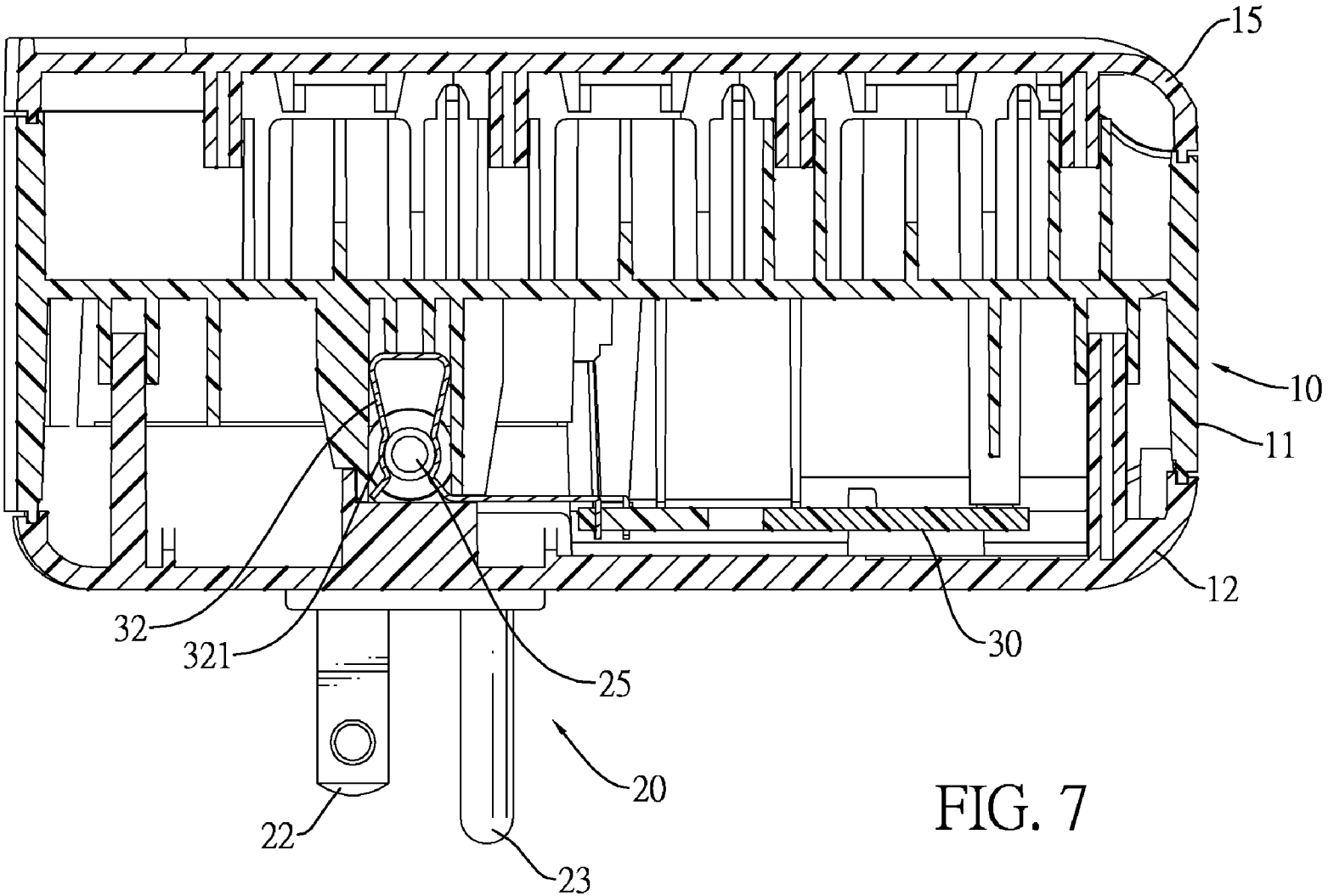
FIG. 7 is a first cross-sectional side view of the power converter in FIG. 1.

With reference to FIG. 7, each metal pivot shaft 25 is pivotally held by the shaft holder 321 formed on the conducting strip 32 so that the plug 20 is pivotable and an external power source can be connected to the adapter board 30 through the prongs 22.

Figure 3:
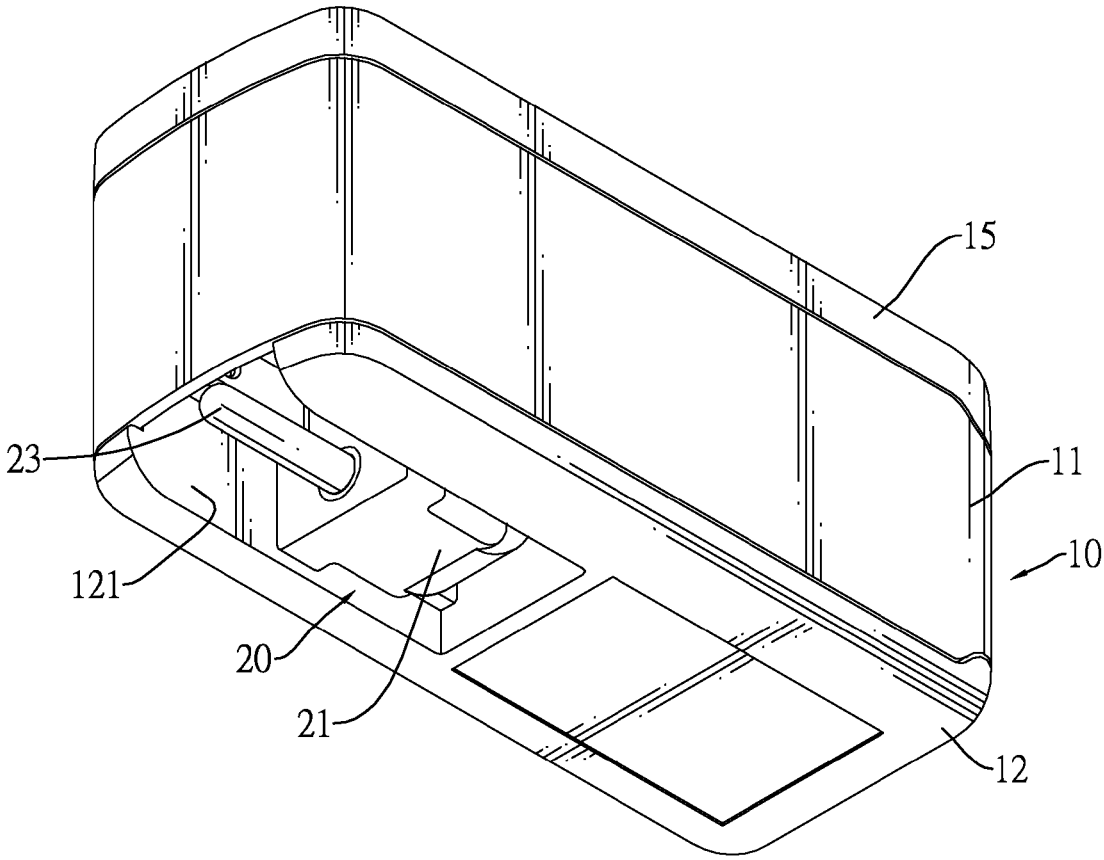
FIG. 3 is a third perspective view of the power converter in FIG. 1.
Figure 4:
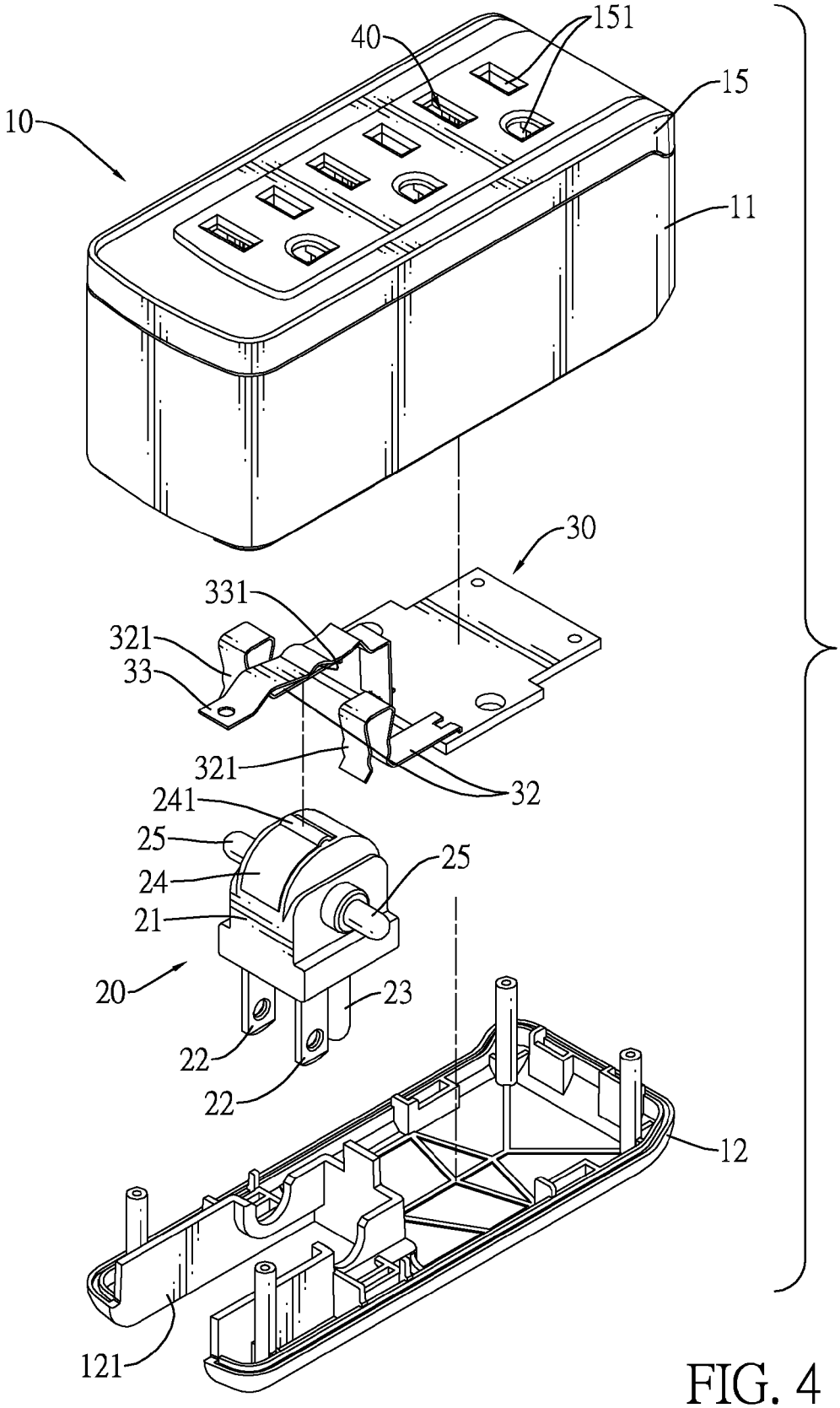
FIG. 4 is an exploded perspective view of the power converter in FIG. 1.
Figure 5:
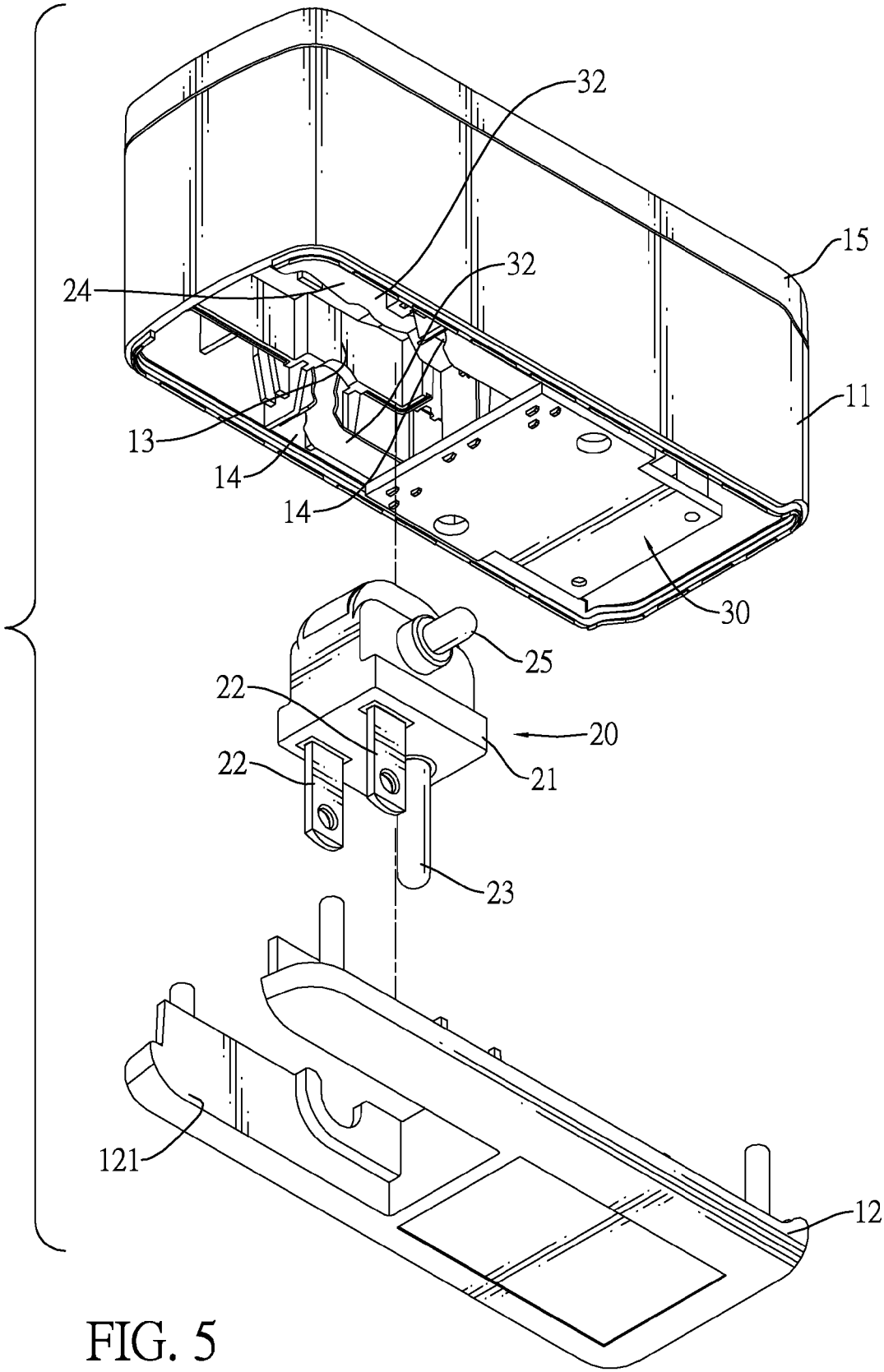
FIG. 5 is a partially exploded perspective view of the power converter in FIG. 1.
Figure 6:
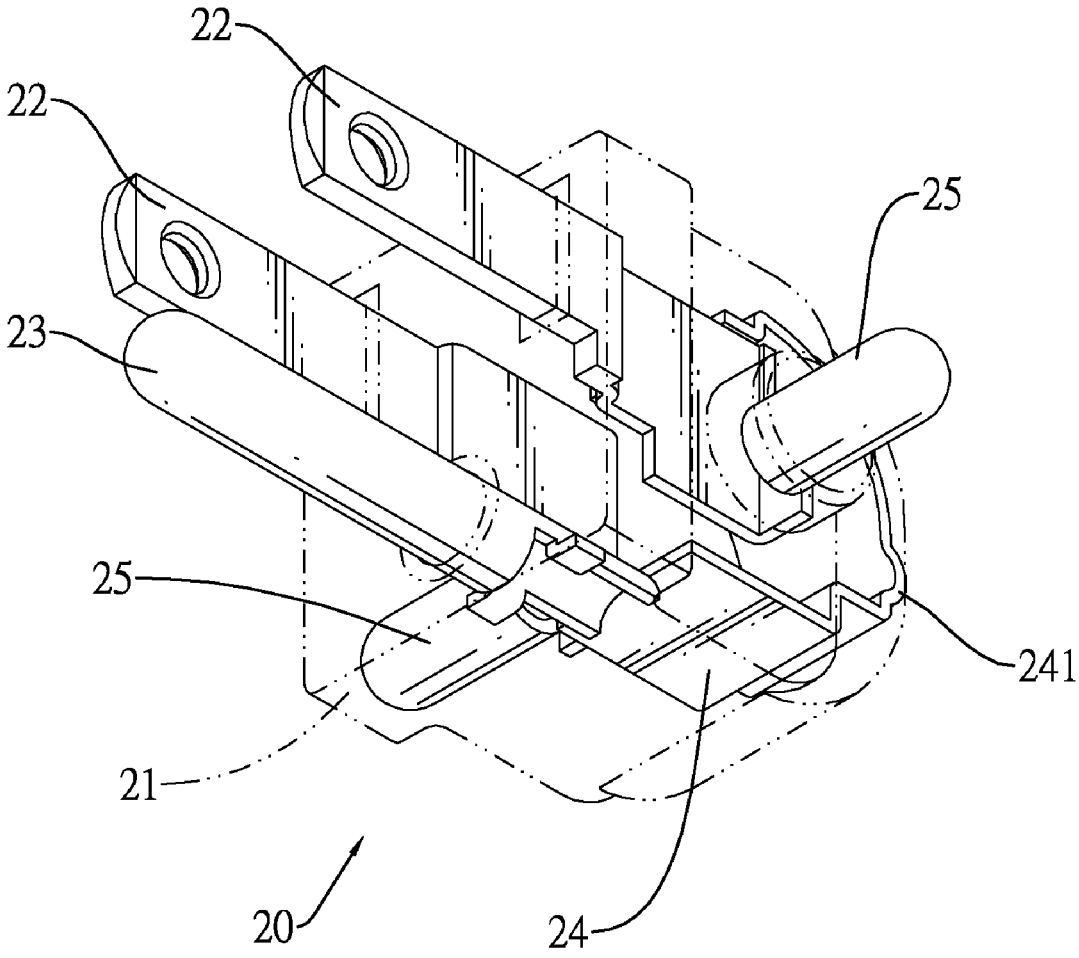
FIG. 6 is a perspective view of the pivotable and receivable plug of the power converter in FIG. 1.
Figure 8:
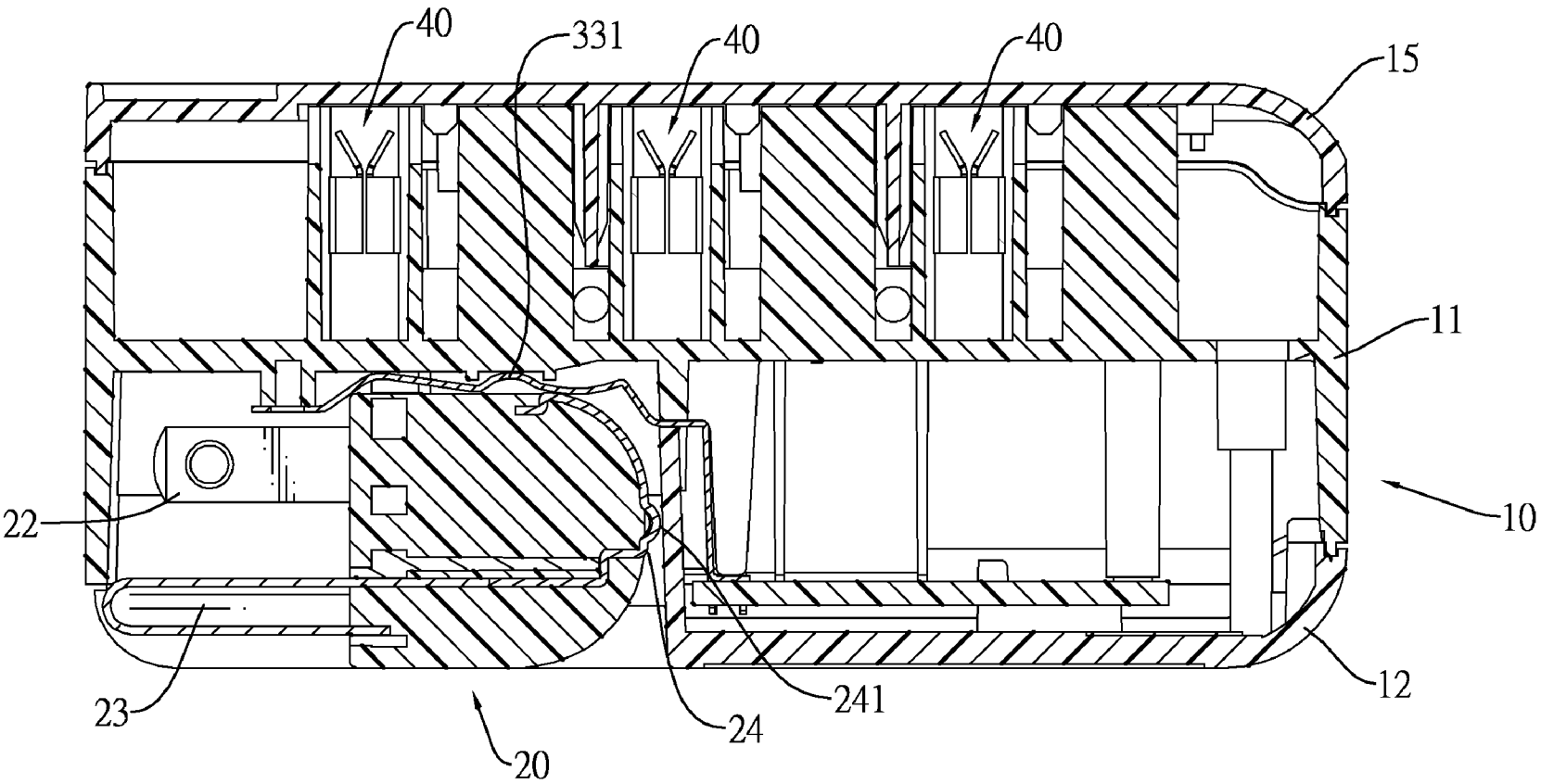
FIG. 8 is a second cross-sectional side view of the power converter in FIG. 1.

With reference to FIGS. 3 and 8, when received, the plug 20 is received in the housing 10, the prongs 22 and the ground pin 23 are hidden inside the chamber 13, and the second engagement portion 241 on the ground plate 24 does not engage the first engagement portion 331 of the grounding strip 33 and the plug 20 is pivotable.

Figure 2:
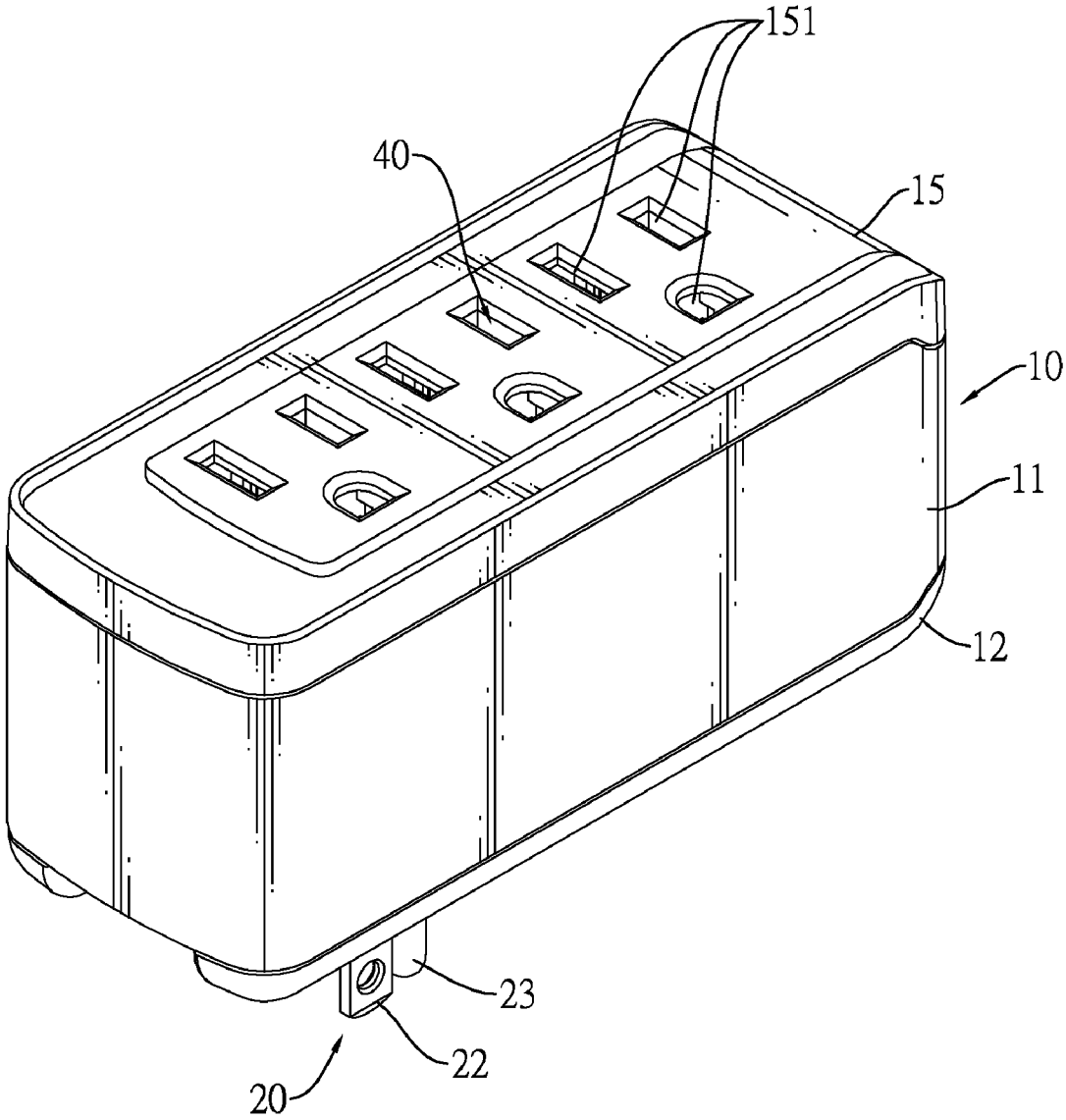
FIG. 2 is a second perspective view of the power converter in FIG. 1.
Figure 9:
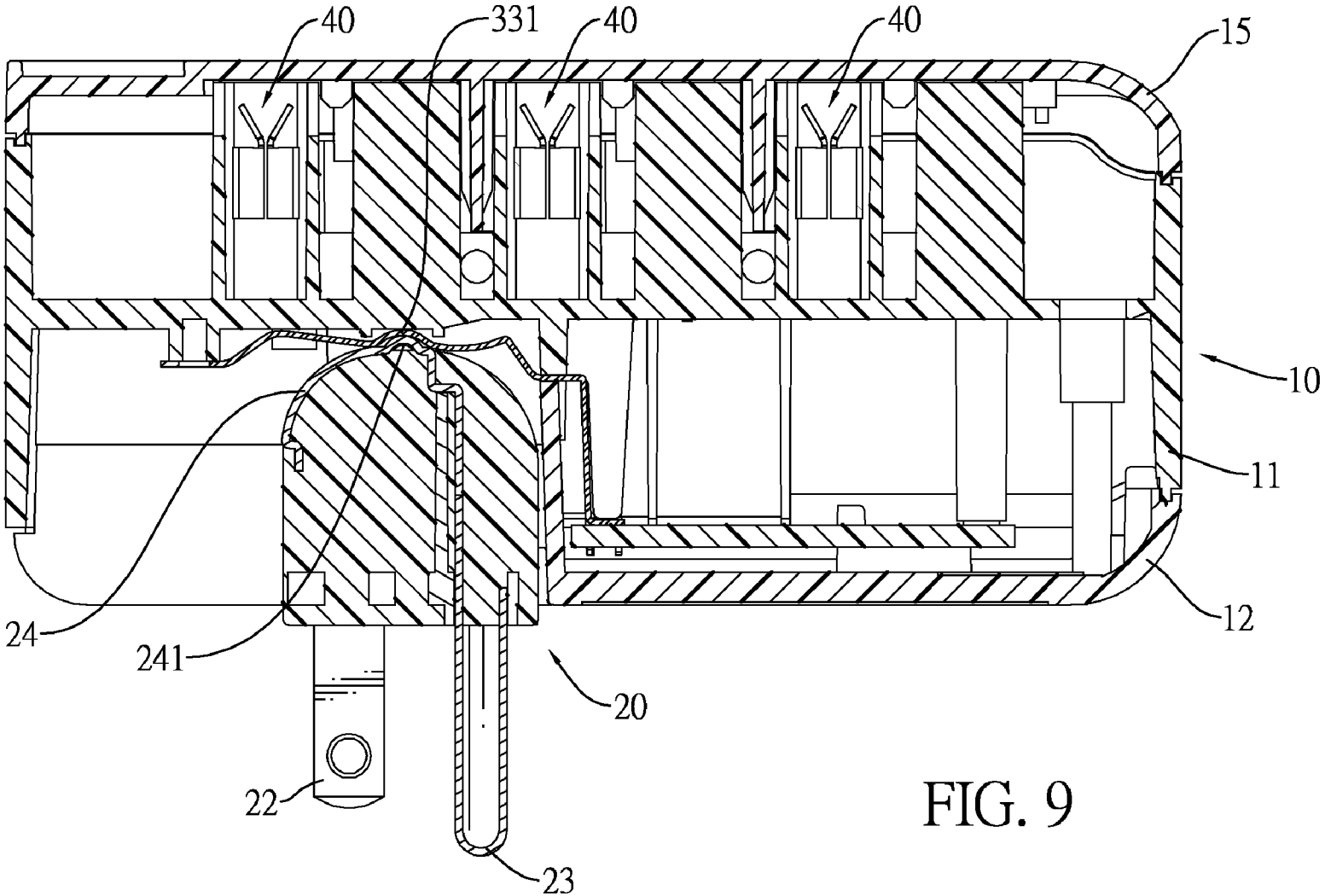
FIG. 9 is a second cross-sectional side view of the power converter in FIG. 3.

With reference to FIGS. 1, 2 and 9, when operated, the plug 20 is pivoted so that the prongs 22 and the ground pin 23 protrude beyond the rectangular opening 121, and the prongs 22 and the ground pin 23 are plugged into a power socket. When the plug 20 is pivoted, the ground plate 24 on the rear of the plug body 21 remains in contact with the grounding strip 33. When the second engagement portion 241 of the ground plate 24 engages the first engagement portion 331 of the grounding strip 33, the plug is positioned and is not pivotable.

Figure 10:
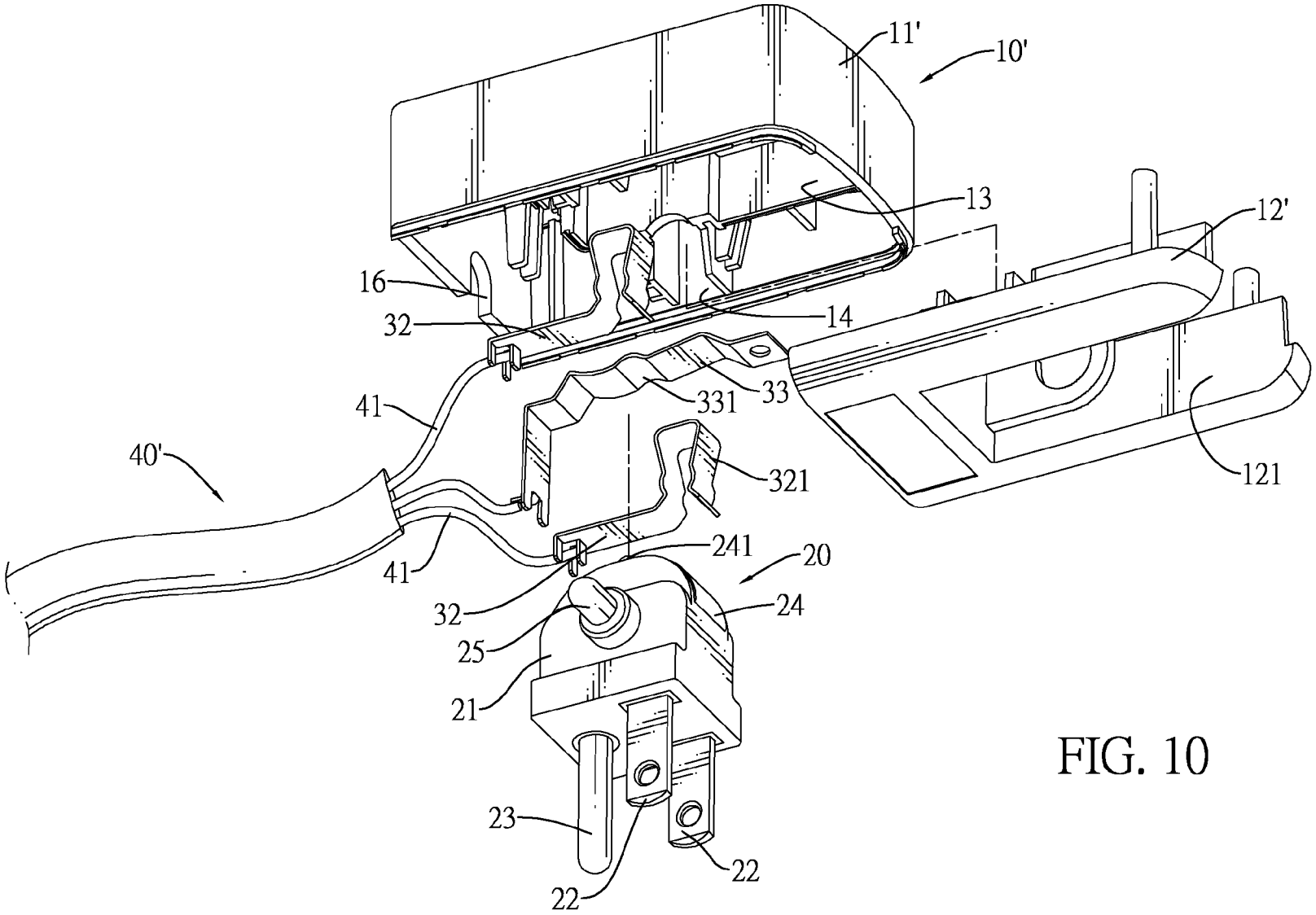
FIG. 10 is a second embodiment of an exploded perspective view of the power converter in accordance with the present invention.
Figure 11:
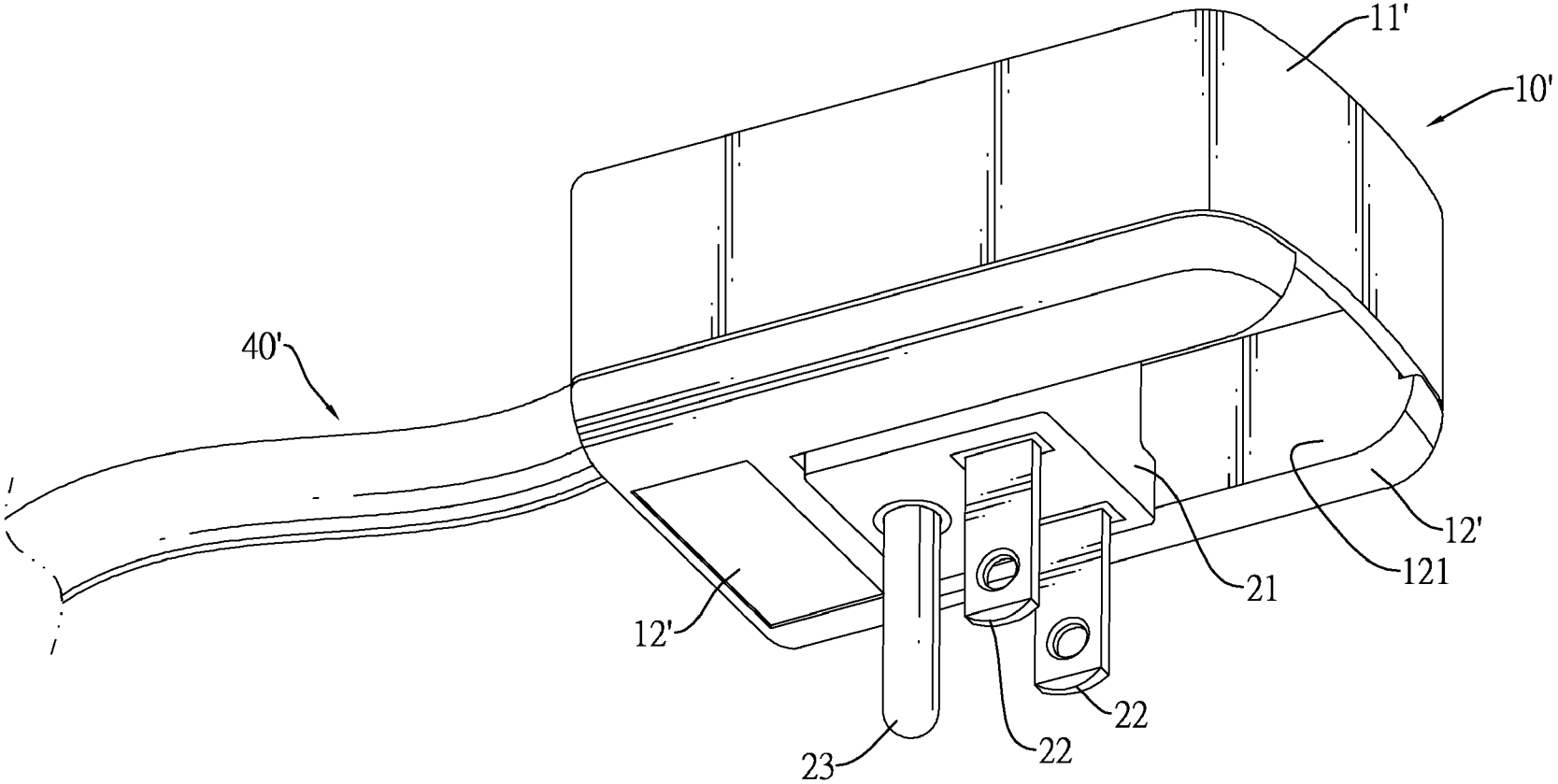
FIG. 11 is a perspective view of the power converter in FIG. 10.
Figure 12:
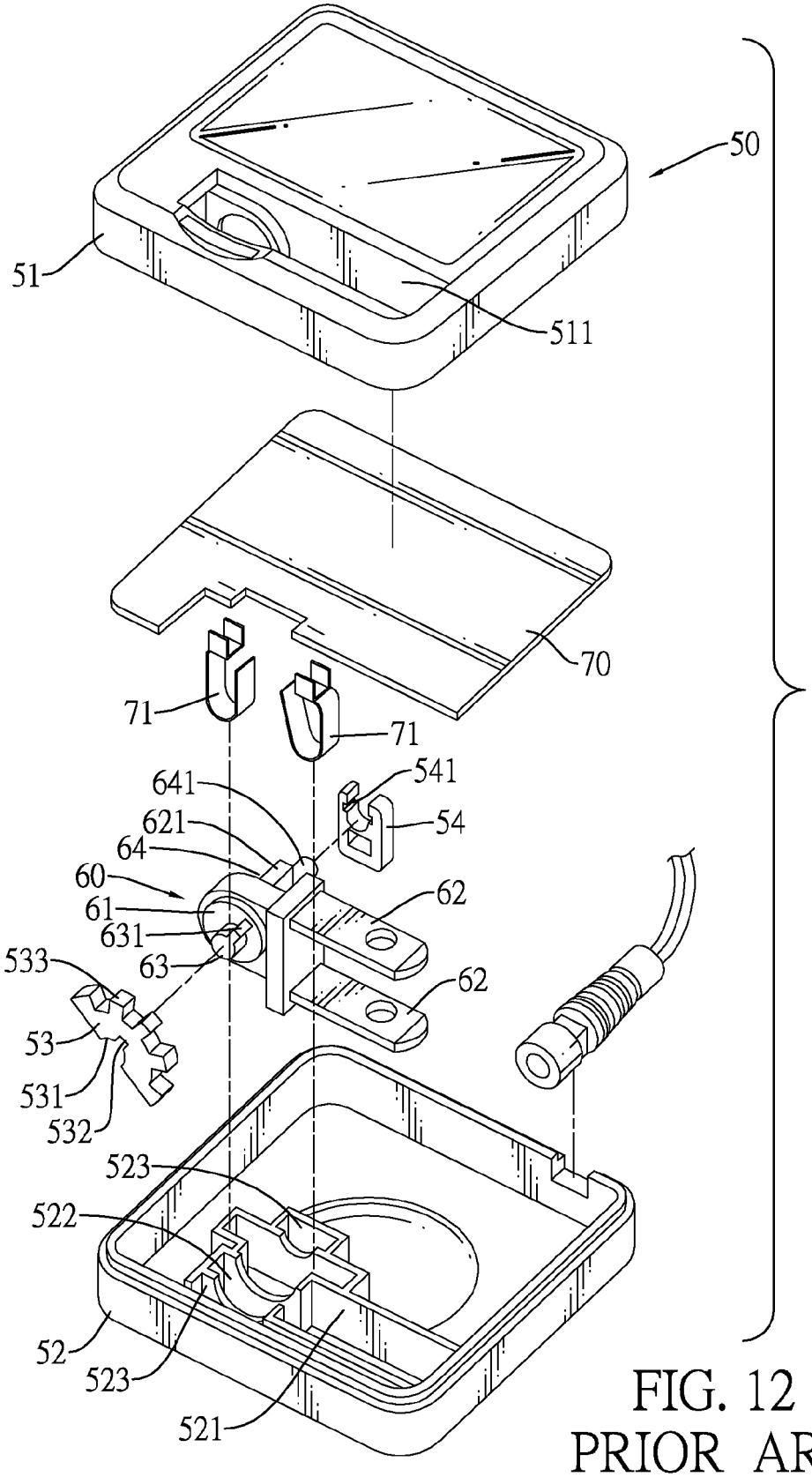
FIG. 12 PRIOR ART
FIG. 12 is an exploded perspective view of a conventional power converter having a pivotable and receivable power plug.

With reference to FIGS. 10 and 11, a second embodiment of a power converter having a pivotable and receivable power plug in accordance with the present invention has a housing 10', a power output unit 40' and a plug 20.

The housing 10' has a body 11', a bottom cover 12', two conducting strips 32 and a grounding strip 33. The body 11' has a chamber 13, an open side, a cable hole 16 and two pivot shaft slots 14. The chamber 13 is defined in the body 11'. The open side is formed through a bottom of the body 11'. The cable hole 16 is formed through a rear wall of the body 11'. The pivot shaft slots 14 are respectively formed on two lateral inner walls of the body 11'. The bottom cover 12' covers the open side of the body 11' and has a rectangular opening 121 formed through the bottom cover 12'. Each conducting strip 32 is resilient and has a shaft holder 321 formed by bending a free end of the conducting strip 32, being U-shaped and securely mounted in one of the pivot shaft slots 14 by abutting against two inner walls of the pivot shaft slot 14. The grounding strip 33 is resilient and has a first engagement portion 331 formed thereon.

The power output unit 40' has multiple power wires 41 passing through the cable hole 16 and electrically and respectively connected with the conducting strips 32 and the grounding strip 33.

The plug 20 is mounted in the housing 10' to align with the rectangular opening 121 of the bottom cover 12', and has a plug body 21, two prongs 22, a ground pin 23, a ground plate 24 and two metal pivot shafts 25. The prongs 22 and the ground pin 23 are parallelly mounted in a front of the plug body 21. The ground plate 24 is mounted in a rear of the plug body 21 and is electrically connected with the ground pin 23. The ground plate 24 has a second engagement portion 241 formed thereon to correspond to the first engagement portion 331 of the grounding strip 33. The metal pivot shafts 25 are respectively mounted in a left side and a right side of the plug body 21, are electrically and respectively connected with the prongs 22, and are pivotally and respectively mounted in the shaft holders 321. The first engagement portion 331 may be a recess, and the second engagement portion 241 is a bump, or vice versa, to engage the first engagement portion 331.

In contrast to the first embodiment, the power output unit of the present embodiment has multiple power wires directly connected with the corresponding conducting strips 32 and the grounding strip 33 to constitute a power cable having a pivotable plug.

In sum, the present invention requires no additional pivot shafts and pivot shaft holders because the metal pivot shaft 25 of the plug 20 and the shaft holders 321 are directly formed by respectively bending the free ends of the conducting strips 32. Additionally, the engagement mechanism directly formed on the conducting strip 33 and the ground plate 24 of the plug 20 positions the plug when the plug 20 is pivoted and thus requires no additional positioning parts. Accordingly, the present invention can be manufactured with minimum parts and is cost-saving.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A power converter having a pivotable and receivable power plug, comprising:

a housing having a rectangular opening formed through one side thereof;

an adapter board mounted inside the housing and having:

two conducting strips, each conducting strip being resilient and having a shaft holder formed by bending a free end of the conducting strip; and a grounding strip having a first engagement portion formed thereon;

a power output unit mounted inside the housing and electrically connected to the adapter board; and a plug mounted inside the housing to align with the rectangular opening of the housing, and having:

a plug body;

two prongs and a ground pin parallelly mounted in a front of the plug body;

a ground plate mounted in a rear of the plug body and electrically connected with the ground pin and having a second engagement portion formed thereon to correspond to the first engagement portion of the grounding strip; and two metal pivot shafts respectively mounted in a left side and a right side of the plug body, electrically and respectively connected with the prongs, and pivotally and respectively mounted in the shaft holders.

2. The power converter as claimed in claim 1, wherein the housing has:

a body having:

a chamber defined in the body;

two open sides respectively formed through a top and a bottom of the body; and two pivot shaft slots respectively formed on two opposite inner sides of the body, wherein each conducting strip is securely mounted in one of the pivot shaft slots by abutting against two inner walls of the pivot shaft slot;

a top cover covering the open side on the top of the body; and a bottom cover covering the open side on the bottom of the body and having the rectangular opening formed through the bottom cover.

3. The power converter as claimed in claim 1, wherein the first engagement portion is a recess, and the second engagement portion is a bump.

4. The power converter as claimed in claim 2, wherein the first engagement portion is a recess, and the second engagement portion is a bump.

5. The power converter as claimed in claim 1, wherein the first engagement portion is a bump, and the second engagement portion is a recess.

6. The power converter as claimed in claim 2, wherein the first engagement portion is a bump, and the second engagement portion is a recess.

7. The power converter as claimed in claim 1, wherein the top cover has multiple sockets, and the power output unit is a multiple-socket receptacle strip corresponding to the sockets of the top cover.

8. The power converter as claimed in claim 2, wherein the top cover has multiple sockets, and the power output unit is a multiple-socket receptacle strip corresponding to the sockets of the top cover.

9. The power converter as claimed in claim 3, wherein the top cover has multiple sockets, and the power output unit is a multiple-socket receptacle strip corresponding to the sockets of the top cover.

10. The power converter as claimed in claim 4, wherein the top cover has multiple sockets, and the power output unit is a multiple-socket receptacle strip corresponding to the sockets of the top cover.

11. The power converter as claimed in claim 5, wherein the top cover has multiple sockets, and the power output unit is a multiple-socket receptacle strip corresponding to the sockets of the top cover.

12. The power converter as claimed in claim 6, wherein the top cover has multiple sockets, and the power output unit is a multiple-socket receptacle strip corresponding to the sockets of the top cover.

13. The power converter as claimed in claim 1, wherein the power output unit is a power output port of a rectifier or a power output port of a transformer.

14. The power converter as claimed in claim 2, wherein the power output unit is a power output port of a rectifier or a power output port of a transformer.

15. The power converter as claimed in claim 3, wherein the power output unit is a power output port of a rectifier or a power output port of a transformer.

16. The power converter as claimed in claim 4, wherein the power output unit is a power output port of a rectifier or a power output port of a transformer.

17. The power converter as claimed in claim 5, wherein the power output unit is a power output port of a rectifier or a power output port of a transformer.

18. The power converter as claimed in claim 6, wherein the power output unit is a power output port of a rectifier or a power output port of a transformer.

19. A power converter having a pivotable and receivable power plug, comprising:

a housing having:

a rectangular opening formed through a bottom thereof;

a cable hole formed through a rear thereof;

two conducting strips, each conducting strip being resilient, and having a shaft holder formed by bending a free end of the conducting strip and securely mounted in the housing; and a grounding strip being resilient and having a first engagement portion formed thereon;

a power output unit having multiple power wires passing through the cable hole and electrically and respectively connected with the conducting strips and the grounding strip; and a plug mounted inside the housing to align with the rectangular opening of the housing, and having:

a plug body;

two prongs and a ground pin parallelly mounted in a front of the plug body;

a ground plate mounted in a rear of the plug body and electrically connected with the ground pin and having a second engagement portion formed thereon to correspond to the first engagement portion of the grounding strip; and two metal pivot shafts respectively mounted in a left side and a right side of the plug body, electrically and respectively connected with the prongs, and pivotally and respectively mounted in the shaft holders.

20. The power converter as claimed in claim 19, wherein the housing further has:

a body having:

a chamber defined in the body;

an open side formed through a bottom of the body;

the cable hole formed through a rear of the body; and two pivot shaft slots respectively formed on two lateral inner walls of the body, wherein each conducting strip is securely mounted in one of the pivot shaft slots by abutting against two inner walls of the pivot shaft slot; and a bottom cover covering the open side of the body and having the rectangular opening formed through the bottom cover.

21. The power converter as claimed in claim 19, wherein the first engagement portion is a recess, and the second engagement portion is a bump.

22. The power converter as claimed in claim 20, wherein the first engagement portion is a recess, and the second engagement portion is a bump.

23. The power converter as claimed in claim 21, wherein the first engagement portion is a recess, and the second engagement portion is a bump.

24. The power converter as claimed in claim 22, wherein the first engagement portion is a recess, and the second engagement portion is a bump.

* * * * *